United States Patent [19]

Hisajima et al.

[11] Patent Number: 4,618,252

[45] Date of Patent: Oct. 21, 1986

[54] COPYING MACHINE WITH A VARIABLE MAGNIFICATION DEVICE

[75] Inventors: Masahiko Hisajima, Ikoma; Yutaka Shigemura, Takarazuka; Yoshinori Makiura, Tondabayashi; Mitsuya Ishito, Sakai, all of Japan

[73] Assignee: Mita Industrial Co., Ltd., Osaka, Japan

[21] Appl. No.: 714,745

[22] Filed: Mar. 22, 1985

[30] Foreign Application Priority Data

Mar. 27, 1984 [JP] Japan ..... 59-60241

[51] Int. Cl.[4] ..... G03G 15/00

[52] U.S. Cl. ..... 355/55; 355/14 SH

[58] Field of Search ..... 355/55, 14 SH, 14 R

[56] References Cited

U.S. PATENT DOCUMENTS 4,222,660 9/1980 Furuichi et al. ..... 355/55 X

*Primary Examiner*—L. T. Hix

*Assistant Examiner*—D. Rutledge

*Attorney, Agent, or Firm*—Beveridge, DeGrandi & Weilacher

[57] ABSTRACT

A copying machine with a variable magnification device comprising two paper cassettes mounted in a drawable manner in vertically spaced relation and a select key for the paper cassettes, wherein the desired cassette can be selected as a source of the copying paper by operating the select key. The upper paper cassette is provided with the copying paper for variable magnification copying, and the upper cassette is automatically selected as the paper source when a detector indicates that the variable magnification copying mode has been selected.

5 Claims, 3 Drawing Figures

COPYING MACHINE WITH A VARIABLE MAGNIFICATION DEVICE

BACKGROUND OF THE INVENTION

The present invention relates to a copying machine with a variable magnification device. More specifically, the present invention relates to a copying machine which can produce a copied image in enlarged or reduced sizes with respect to an original and comprises the paper cassettes mounted in two vertical rows.

A basic configuration of a transfer type electrostatic copying machine which forms an electrostatic latent image on a photoreceptor by exposing the original, develops the electrostatic latent image by a toner and produces a copied image corresponding to the original image by transferring the toner image is commonly known hitherto and has been generally used.

Recently, in order to have various sizes of the original and copied images in different sizes from the original to meet the needs of the customers, the copying magnification is made possible to be selected and the paper feeding are diversified and there is provided the copying machine having the paper cassettes mounted in vertically spaced relation so that they can be selectively pulled off for avoiding troubles of replacing the cassette at every occasion when a different size of the original and/or the magnification are wanted.

In such copying machine, a select key is provided for selecting either of the two paper cassettes mounted in two vertical rows.

Moreover, demands for higher copying speed are strong in recent time and in equal size copying the copying paper is now fed laterally (from a shorter side) to reduce the feeding time which is the main influential factor to affect the copying speed. For variable magnification copying such as when enlarging or reducing the sizes, however, the paper must be fed in proportion to a direction in which the copied image with the variable magnification is formed, that is, the paper is usually fed longitudinally (from a longer side).

Accordingly, even when using the same size paper, the different cassettes have to be used.

In such a configuration, a desired copying may be accomplished without any possibility of miscopying by operating the select key for the paper cassette in accordance with the equal and variable magnification copyings even when using the same paper size. But the operation for selecting the lateral feeding cassette or the longitudinal feeding cassette becomes essential, which is not only troublesome, but, in the worst case, may cause inconveniences such as the miscopying due to the negligence of operation.

Furthermore, there is in the market such a copying machine adapted to select automatically the paper cassette most frequently used as the source of the copying paper in the initial stage after supplying the power to the copying machine or when the machine is not being operated for a fixed period of time. However, it is hardly possible to improve the convenience of operation for use in response to the need of equal and variable magnification copyings, thus the same inconvenience as mentioned above exists.

SUMMARY OF THE INVENTION

It is an object of the present invention to select an upper paper cassette for feeding the copying paper automatically when a variable magnification copying mode has been selected.

Another object of the present invention is to eliminate special troubles for selecting a paper cassette when a variable magnification copying mode has been selected.

It is a still other object of the present invention to prevent miscopying due to negligence of selecting a paper cassette when a variable magnification copying mode has been selected.

A copying machine as disclosed in the present invention has a variable magnification device and is operable in different modes, one of which is a variable magnification copying mode. Two paper cassettes are mounted in a drawable manner and they are arranged in vertically spaced relation so there is an upper cassette and a lower cassette, a desired one of which can be selected by a paper cassette select key as the source of the copying paper. According to the invention, the machine is provided with a detection means which detects when the variable magnification copying mode has been selected, whereupon the detection means provides a signal to indicate that the variable magnification copying mode has been selected. An automatic cassette selection means is provided to select the upper paper cassette in response to the signal from the detection means which shows that the variable magnification copying mode has been selected.

BRIEF DESCRIPTION OF THE PREFERRED EMBODIMENTS

Figure 1:
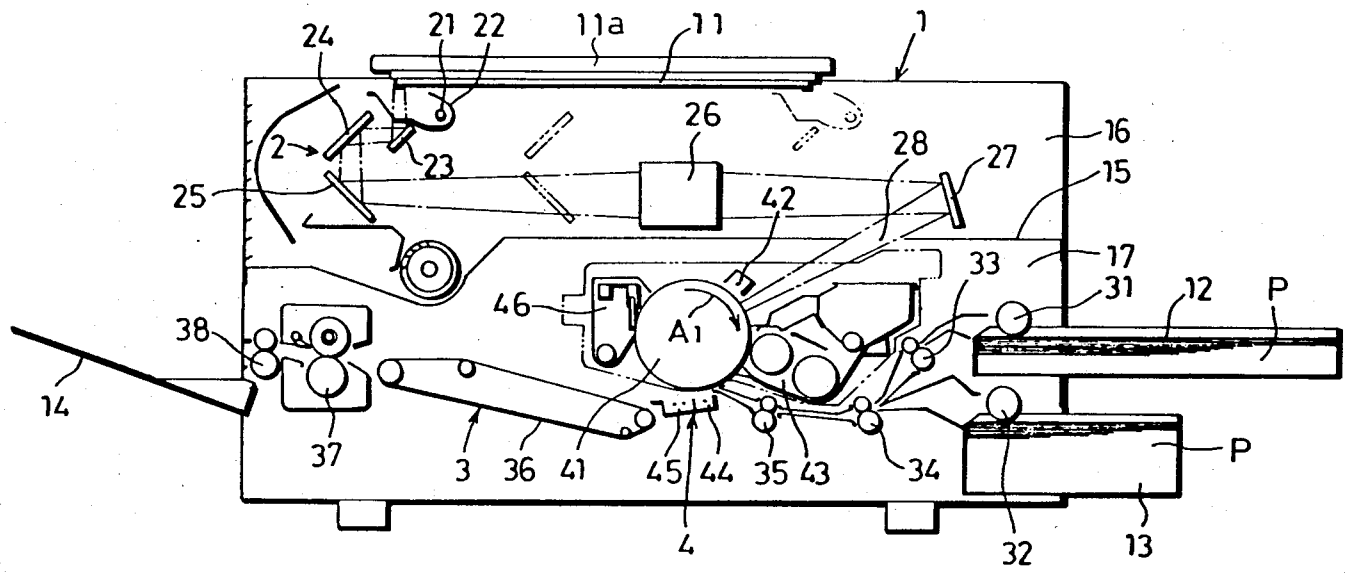
FIG. 1 is a schematic view showing an internal structure of a copying machine with a varaible magnification device.

FIG. 1 is a schematic view showing an internal structure of a copying machine.

A copying machine body (1) is provided with an original table (11) capable of placing an original of A-3 size (420 mm×297 mm) on an upper surface thereof, the original table (11) having an original cover **(11*a*) for immovably placing the original thereon, two paper cassettes (12) (13) mounted in a drawable manner on the right lower side and a tray (14) for receiving the copied paper disposed at a fixed position on a left side. A partition (15) provided at an inner fixed position of the body (1) forms an upper chamber (16) and a lower chamber (17), wherein an optical system (2) is arranged movably in reciprocation in the upper chamber (16) and a copy treatment section (4) and a conveying section (3) for the copying paper are provided in the lower chamber (17)**.

The optical system (2) comprises a light source (21), No. 1 reflector (22) having a concave reflecting surface, No. 2 reflector (23), No. 3 reflector (24), No. 4 reflector (25), lens (26) and No. 5 reflector (27), wherein the light source (21), No. 1 reflector (22) and No. 2 reflector (23) reciprocate once in every copying operation at a speed corresponding to an magnification thereby enabling a scanning exposure of the original on the original table (11) successively, thus the reflected light from the original is irradiated on the surface of the photoreceptor drum (41) to be described later after passing through No. 3 reflector (24) and No. 4 reflector (25) which move following the movements of the light source (21), No. 1 reflector (22) and No. 2 reflector (23) at half of the speed thereof, lens (26), No. 5 reflector (27) and the slit (28) formed at the fixed position on the partition (15).

Further, the lens (26) is adapted to gain the necessary copying magnification by reciprocating along the light path. The lens (26) used in the embodiment is positioned by displacing in such a way to gain the magnification of 122 percent in case for the enlarged copying and the magnifications of 82 and 71 percent in case for the reduced copying. However, it can be positioned to gain other magnifications than mentioned above, or further, a zoom lens may be employed as the lens (26).

Figure 2:
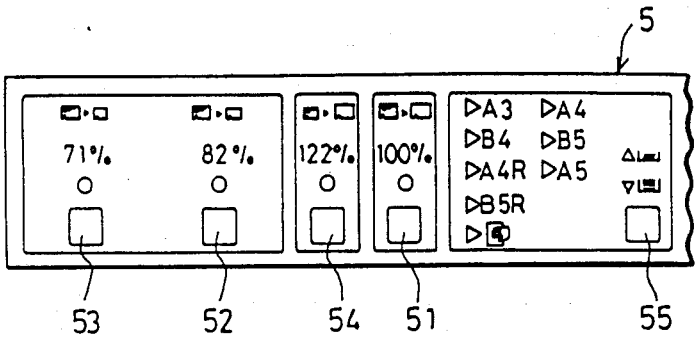
FIG. 2 is a plan view showing an operation panel of a copying machine with a variable magnification device.

The selections of copying magnifications mentioned above can be made by operating an equal key (51), a reducing keys (52) (53) and an enlarging key (54) on the operation panel (5) (Refer to FIG. 2), but also a ten-key or the like may be used for setting the desired magnification directly.

The conveying section (3) for the copying paper comprises the feed rollers (31) (32) which feed the copying paper (P) to the conveying roller (33) (34) by taking out one by one from the respective cassettes (12) (13), a resist roller (35) which feeds the copying paper (P) fed by the conveying roller (34) to the copy treatment section (4), a belt (36) which conveys the copying paper (P) separated from the copy treatment section (4) to a fusing roller, the fusing roller (37) which heats and fuses a toner image on the copying paper (P) and a delivery roller (38) which delivers the copying paper (P) after being heated and fused to the tray (14), wherein the copying paper (P) in the desired cassettes (12) or (13) may be fed one by one to the copy treatment section (4) by driving the feed rollers (31) (32) selectively.

The copy treatment section (4) is arranged at a generally center portion in the lower chamber (17) and provided with the photoreceptor drum (41) which rotates in one direction (a direction shown by the arrow A1 in the drawing) in every copying operation and an corona charger (42), a developing means (43), a transfer charger (44), a separation charger (45) and a cleaner (46) are arranged in the peripheral thereof in that order. Accordingly, one copying operation may be accomplished by forming the electrostatic latent image corresponding to the original by the irradiated light through the slit (28) after the photoreceptor layer on the photoreceptor drum (41) being charged uniformly by the corona charger (42), developing the electrostatic latent image into the toner image by the developing means (43), transferring the toner image onto the copying paper (P) fed from the resist roller (35) by the transfer charger (44), separating the copying paper (P) from the photoreceptor drum (41) by the separation charger (45) and finally recovering the toner remained on the photoreceptor drum (41) by the cleaner (46).

The upper one (12) out of a two cassettes (12) (13) mounted to the copying machine aforementioned is for the longitudinal feeding of an infrequent use, for instance, the A-4 size (297 mm×210 mm) and for a relatively small quantity of 250 sheets, whereas the lower cassette (13) is for the lateral feeding of a frequent use of the same size and for a relatively large quantity of 500 sheets. Accordingly, while the cassette (13) is being mounted as long as the paper remain, the cassette (12) must be replaced relatively simply correspondingly with the original sizes, copying magnifications and the like and normally, the one for longitudinal feeding and the A-4 size, as mentioned above, will be mounted.

Figure 3:
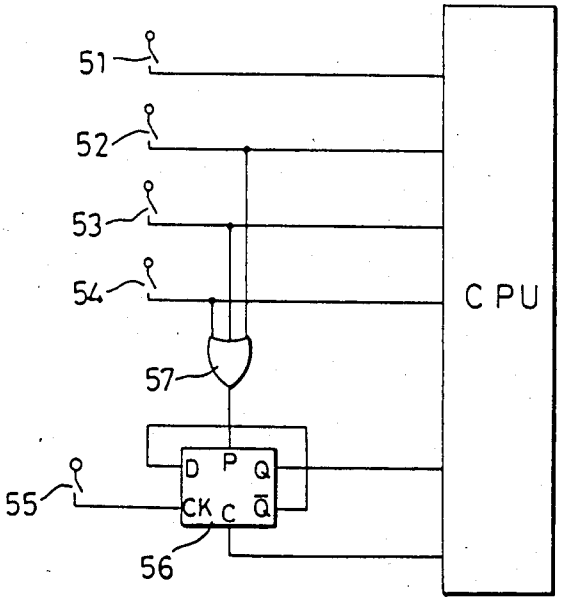
FIG. 3 is a block diagram showing a control circuit constituting a major portion of the present invention.

FIG. 3 is an electrical diagram, wherein the selet key (55) for the paper cassette is connected to a clock input terminal of a D flip-flop (56) (a type which operates synchronously with the build-up of a clock pulse and provides an input for the delay input terminal at the Q output terminal by delaying one period of the clock pulse), the reducing keys (52) (53) and an enlarging key (54) are connected via an OR gate (57) to a preset input terminal of the D flip-flop (56) and Q output terminal thereof is connected to a microcomputer (CPU), an output terminal thereof is connected to a clear input terminal of the D flip-flop (56) and further, an equal key (51), the reducing keys (52) (53) and the enlarging key (54) are connected directly to the microcomputer (CPU).

Furthermore, it is arranged in such a way that when the Q output signal of the D flip-flop (56) has a high level the upper paper cassette (12) will be selected and when the signal level is low the lower paper cassette (13) will be selected.

With the configuration mentioned above, when the power is switched on or when the copying operation has not been performed for a fixed period of time, the Q output signal level of the D flip-flop (56) is lowered by the auto clear/initial signal from the mcirocomputer (CPU) and the lower cassette (13) for the frequent use will be selected, and when the reducing keys (52) (53) or the enlarging key (54) are operated, the Q output signal level of the D flip-flop (56) is increased by the P input signal impressed through the OR gate (57) and the upper cassette (12) for the infrequent use will be selected.

Moreover, when the selection key (55) for the paper cassette is operated thereafter, since the Q output signal of the D flip-flop (56) will be changed from the high to low lever or vice versa, any incomplete selecting operation mentioned above may be successively dealt with.

According to the copying machine of the present invention with the variable magnification device which is constituted as previously mentioned, since the upper paper cassette is selected automatically when selecting the variable magnification copying mode, an annoying trouble such as reselecting the upper paper cassette by operating the select key for the cassette on every selection of the variable magnification device can be eliminated and a wasteful copying due to the negligence of selecting the paper cassette can be avoided.

It is still to be understood that the present invention is not limited to the embodiment mentioned above and various changes and modifications in designs may be made without departing from the scope or changing the purpose of the present invention.

What we claim is:

1. A copying machine which has a variable magnification device and is operable in a variable magnification copying mode, comprising two paper cassettes mounted in a drawable manner in vertically spaced relation so that there is an upper cassette and a lower cassette, wherein a desired paper cassette can be selected by a select key for the paper cassette as the source of copying paper for the machine, characterized in that there are provided a detection means for detecting when said variable magnification copying mode has been selected, said detection means being operable to provide a signal when said variable magnification copying mode has been selected, and, a cassette selection means for selecting an upper paper cassettte as the source of the copying paper, said selection means being operable automatically to select the upper cassette in response to said signal from the detection means showing that the variable magnification copying mode has been selected.

2. A copying machine with a variable magnification device according to claim 1, wherein an upper cassette is for a longitudinal feeding of the copying paper and a lower cassette is for a lateral feeding of the copying paper.

3. A copying machine with a variable magnification device according to claim 1, wherein a selection means comprises a D flip-flop.

4. A copying machine with a variable magnification device according to claim 1, comprising a detection means for detecting an initial stage of the power supply and a standstill condition for the fixed period of time, and a selection means for selecting a lower paper cassette as the source of the copying paper by the signal from the detection means showing the initial stage of the power supply and the standstill condition for the fixed period of time as an input.

5. A copying machine with a variable magnification device according to claim 4, wherein a selection means for selecting the upper paper cassette and another for selecting the lower paper cassette as the feeding side of the copying paper are comprised in a common D flip-flop.

* * * * *